US007732020B2

(12) United States Patent
King et al.

(10) Patent No.: US 7,732,020 B2
(45) Date of Patent: Jun. 8, 2010

(54) METHOD AND APPARATUS FOR THE APPLICATION OF POWDER MATERIAL TO SUBSTRATES

(75) Inventors: Russell Stuart King, Northants (GB); Michael John Holroyd, Cambridge (GB); David Michael Billington, Northamptonshire (GB)

(73) Assignee: Glaxo Group Limited, Middlesex (GB)

( * ) Notice: Subject to any disclaimer, the term of this patent is extended or adjusted under 35 U.S.C. 154(b) by 761 days.

(21) Appl. No.: 10/594,579

(22) PCT Filed: Mar. 31, 2005

(86) PCT No.: PCT/GB2005/001247

§ 371 (c)(1),
(2), (4) Date: Mar. 8, 2007

(87) PCT Pub. No.: WO2005/095002

PCT Pub. Date: Oct. 13, 2005

(65) Prior Publication Data

US 2007/0240976 A1 Oct. 18, 2007

(30) Foreign Application Priority Data

Mar. 31, 2004 (GB) ..... 0407312.8

(51) Int. Cl.
*B05D 1/06* (2006.01)
*B05C 19/06* (2006.01)

(52) U.S. Cl. ..... 427/485; 427/2.14; 427/598; 118/623; 118/661

(58) Field of Classification Search ..... 427/485, 427/2.14; 118/623
See application file for complete search history.

(56) References Cited

U.S. PATENT DOCUMENTS 3,323,933 A * 6/1967 Barford et al. ..... 427/485
3,388,685 A 6/1968 Price
3,764,538 A 10/1973 Shelffo
3,802,380 A 4/1974 Ford et al.
4,029,757 A 6/1977 Mlodozeniec et al.

(Continued)

FOREIGN PATENT DOCUMENTS

DE 31 069 84 A1 2/1982

(Continued)

OTHER PUBLICATIONS

Newman, Michael, et al., "*Method and Apparatus for the Application of Powder Material to Substrates*", U.S. Appl. No. 10/571,909, Mar. 14, 2006.

(Continued)

*Primary Examiner*—Frederick J Parker
(74) *Attorney, Agent, or Firm*—Buchanan Ingersoll & Rooney PC

(57) ABSTRACT

An apparatus for electrostatically charging powder material and supplying it to an applicator for electrostatically applying the powder material to solid dosage forms includes a mixer for mixing a sump of the powder material to electrostatically charge the powder material, the mixer including two substantially parallel elongate mixing shafts having oppositely angled mixing paddles thereon and being arranged to rotate in opposite directions; and a feeder for removing the electrostatically charged powder material from the sump and supplying it to the applicator, and a method for electrostatically charging powder material and supplying it to an applicator for electrostatically applying the powder material to solid dosage forms.

50 Claims, 9 Drawing Sheets

U.S. PATENT DOCUMENTS

| | | | | |
|---|---|---|---|---|
| 4,112,215 | A | | 9/1978 | Boessler et al. |
| 4,128,445 | A | | 12/1978 | Sturzenegger et al. |
| 4,146,323 | A | * | 3/1979 | Forward et al. ..... 399/256 |
| 4,176,175 | A | | 11/1979 | Maekawa et al. |
| 4,197,289 | A | | 4/1980 | Sturzenegger et al. |
| 4,201,834 | A | | 5/1980 | Hannon et al. |
| 4,217,853 | A | | 8/1980 | Davitz |
| 4,322,449 | A | | 3/1982 | Voss et al. |
| 4,349,531 | A | | 9/1982 | Mlodozeniec et al. |
| 4,359,483 | A | | 11/1982 | Kaetsu et al. |
| 4,433,076 | A | | 2/1984 | Bauer et al. |
| 4,454,125 | A | | 6/1984 | Demopoulos |
| RE31,764 | E | | 12/1984 | Voss et al. |
| 4,547,571 | A | | 10/1985 | Mukohyama et al. |
| 4,548,825 | A | | 10/1985 | Voss et al. |
| 4,679,526 | A | | 7/1987 | Dziedzic |
| 4,704,295 | A | | 11/1987 | Porter et al. |
| 4,786,505 | A | | 11/1988 | Lovgren et al. |
| 4,800,079 | A | | 1/1989 | Boyer |
| 4,810,501 | A | | 3/1989 | Ghebre-Sellassie et al. |
| 4,828,840 | A | | 5/1989 | Sakamoto et al. |
| 4,925,670 | A | | 5/1990 | Schmidt |
| 4,935,246 | A | | 6/1990 | Ahrens |
| 4,994,273 | A | | 2/1991 | Zentner et al. |
| 5,011,694 | A | | 4/1991 | Nuernberg et al. |
| 5,059,446 | A | | 10/1991 | Winkle, Sr. et al. |
| 5,076,706 | A | | 12/1991 | Shibuya et al. |
| 5,151,739 | A | * | 9/1992 | Hediger ..... 399/256 |
| 5,176,755 | A | | 1/1993 | Winkle, Sr. et al. |
| 5,206,030 | A | | 4/1993 | Wheatley et al. |
| 5,307,124 | A | * | 4/1994 | Stelter ..... 399/62 |
| 5,313,903 | A | | 5/1994 | Goldbach et al. |
| 5,320,796 | A | | 6/1994 | Harashma et al. |
| 5,411,730 | A | | 5/1995 | Kirpotin et al. |
| 5,436,026 | A | | 7/1995 | Berta |
| 5,470,603 | A | | 11/1995 | Staniforth et al. |
| 5,474,605 | A | | 12/1995 | Schmid et al. |
| 5,474,786 | A | | 12/1995 | Kotwal et al. |
| 5,538,125 | A | | 7/1996 | Berta |
| 5,540,995 | A | | 7/1996 | Kitano et al. |
| 5,607,044 | A | | 3/1997 | Berta |
| 5,656,080 | A | | 8/1997 | Staniforth et al. |
| 5,699,649 | A | | 12/1997 | Abrams et al. |
| 5,714,007 | A | | 2/1998 | Pletcher et al. |
| 5,788,814 | A | | 8/1998 | Sun et al. |
| 5,792,513 | A | | 8/1998 | Koslow et al. |
| 5,846,595 | A | | 12/1998 | Sun et al. |
| 5,857,456 | A | | 1/1999 | Sun et al. |
| 6,026,809 | A | | 2/2000 | Abrams et al. |
| 6,074,688 | A | | 6/2000 | Pletcher et al. |
| 6,117,479 | A | | 9/2000 | Hogan et al. |
| 6,294,024 | B1 | | 9/2001 | Sun et al. |
| 6,298,847 | B1 | | 10/2001 | Datta et al. |
| 6,319,541 | B1 | | 11/2001 | Pletcher et al. |
| 6,406,738 | B1 | | 6/2002 | Hogan et al. |
| 6,440,486 | B2 | | 8/2002 | Sun et al. |
| 6,592,671 | B2 | | 7/2003 | Sun et al. |
| 6,783,768 | B1 | | 8/2004 | Brown et al. |
| 7,008,668 | B2 | | 3/2006 | Hogan et al. |
| 7,070,656 | B2 | | 7/2006 | Hogan et al. |
| 2002/0034592 | A1 | | 3/2002 | Hogan et al. |
| 2002/0153056 | A1 | | 10/2002 | Sigegel et al. |

FOREIGN PATENT DOCUMENTS

| | | | |
|---|---|---|---|
| DE | 30 49 179 | A | 7/1982 |
| EP | 0 011 268 | A1 | 5/1980 |
| EP | 0 020 181 | A1 | 12/1980 |
| EP | 0 011 268 | B1 | 12/1982 |
| EP | 0 107 557 | A1 | 5/1984 |
| EP | 0 164 959 | A2 | 12/1985 |
| EP | 0 220 670 | A2 | 5/1987 |
| EP | 0 259 749 | A1 | 3/1988 |
| EP | 0 277 741 | A1 | 8/1988 |
| EP | 0 445 556 | A1 | 9/1991 |
| EP | 0 452 862 | A2 | 10/1991 |
| EP | 0 459 048 | A1 | 12/1991 |
| EP | 0 485 138 | | 5/1992 |
| EP | 0 536 791 | A1 | 4/1993 |
| EP | 0 543 541 | A1 | 5/1993 |
| EP | 0 611 563 | A2 | 8/1994 |
| EP | 0 661 091 | A1 | 7/1995 |
| EP | 0 678 561 | A2 | 10/1995 |
| EP | 0 678 564 | A2 | 10/1995 |
| GB | 1075404 | | 7/1967 |
| GB | 1108837 | | 4/1968 |
| GB | 1 561 100 | | 2/1980 |
| GB | 2 055 619 | A | 3/1981 |
| GB | 2 056 885 | A | 3/1981 |
| GB | 2 065 691 | A | 7/1981 |
| GB | 2 129 301 | A | 5/1984 |
| GB | 2 179 254 | A | 3/1987 |
| GB | 2 203 336 | A | 10/1988 |
| GB | 2 241 889 | A | 9/1991 |
| GB | 2 253 164 | A | 9/1992 |
| GB | 2 333 975 | A | 8/1999 |
| GB | 2 384 199 | A | 7/2003 |
| GB | 2 393 141 | A | 3/2004 |
| GB | 2 402 895 | A | 12/2004 |
| LU | 52460 | | 11/1966 |
| WO | 91/16041 | A1 | 10/1991 |
| WO | 92/11002 | A1 | 7/1992 |
| WO | 92/14451 | A1 | 9/1992 |
| WO | 94/05263 | A1 | 3/1994 |
| WO | 94/11446 | A1 | 5/1994 |
| WO | 96/02236 | A1 | 2/1996 |
| WO | 96/11707 | A1 | 4/1996 |
| WO | 96/35413 | A1 | 11/1996 |
| WO | 96/35516 | A1 | 11/1996 |
| WO | 96/39256 | A1 | 12/1996 |
| WO | 96/39257 | A1 | 12/1996 |
| WO | 97/04827 | A1 | 2/1997 |
| WO | 97/37775 | A1 | 10/1997 |
| WO | 97/37803 | A1 | 10/1997 |
| WO | 97/38480 | A1 | 10/1997 |
| WO | 97/47346 | A1 | 12/1997 |
| WO | 97/47347 | A1 | 12/1997 |
| WO | 99/06593 | A1 | 2/1999 |
| WO | 99/06814 | A1 | 2/1999 |
| WO | 99/13817 | A2 | 3/1999 |
| WO | 02/49771 | A1 | 6/2002 |
| WO | 03/061841 | A1 | 7/2003 |
| WO | 2005/063167 | A2 | 7/2005 |

OTHER PUBLICATIONS

Tullett, Simon, et al., "*Method and Apparatus for the Application of Powder Material to Substrates*", U.S. Appl. No. 10/585,142, Jun. 30, 2006.

Liberto, PE, Nicholas P., "*Chapter 1: Why Powder Coating*?", Powder Coating, the Complete Finisher's Handbook, 1994, pp. 1-7, The Powder Coating Institute, Alexandria, VA.

Kirk-Othmer, "*Powder Coatings to* Recycling", Encyclopedia of Chemical Technology—Third Edition, 1982, pp. 1-2, vol. 19, John Wiley & Sons, New York, NY.

Grosvenor, Ph.D., Martin, "*The physico-mechanical properties of electrostatically deposited polymers for use in pharmaceutical powder coating*", Dissertation Abstracts International, 1993, p. 3492-B, vol. 53, No. 7, UMI (ProQuest), Ann Arbor, MI.

Form PCT/ISA/203 (Declaration of Non-Establishment of International Search Report) dated Jul. 1, 2005.

Form PCT/ISA/237 (Written Opinion of the International Searching Authority) dated Mar. 31, 2005.
Eschborn/Taunus, *Pharmazeutische Stoffliste 13. Auflage, List of Pharmaceutical Substances*, 13th Edition, Sep. 2003, pp. 230-231, Bearbeiter und herausgegeben von Prepared and Published by ABDATA/Pharma-Daten-Service, Germany.

* cited by examiner

METHOD AND APPARATUS FOR THE APPLICATION OF POWDER MATERIAL TO SUBSTRATES

The present invention relates to a method and apparatus for the electrostatic application of powder material to solid dosage forms.

A solid dosage form can be formed from any solid material that can be apportioned into individual units and is, therefore, a unit dose form. A solid dosage form may be, but is not necessarily, an oral dosage form. Examples of pharmaceutical solid dosage forms include pharmaceutical tablets and other pharmaceutical products that are to be taken orally, including pellets, capsules and spherules, and pharmaceutical pessaries, pharmaceutical bougies and pharmaceutical suppositories. Pharmaceutical solid dosage forms can be formed from pharmaceutical substrates that are divided into unit dose forms. Examples of non-pharmaceutical solid dosage forms include items of confectionery, washing detergent tablets, repellents, herbicides, pesticides and fertilisers.

The electrostatic application of powder material to solid dosage forms is known. Examples of patent specifications describing such applications are WO 03/061841 and WO 02/49771.

When coating solid dosage forms electrostatically with powder, it is desirable to accurately control the coating process so that the powder coating on each solid dosage form is as even as possible and of the appropriate thickness. This is done by positioning each solid dosage form appropriately in relation to the coating powder supply and by controlling the properties of the powder supply.

In the applicant's co-pending application no PCT/GB2004/005458, the solid dosage forms are conveyed on platens which move along a drive path. The accurate positioning of the solid dosage forms relative to the coating powder supply is achieved via a guide on the drive path, which fixes each platen at a selected vertical position for the duration of the coating process. Thus, the distance between the powder supply and the surface of the solid dosage form to be coated is accurately controlled. Whilst this method has proved to be very successful, further improvements can be made by controlling the arrangement for supplying the coating powder and the way in which it is applied to the solid dosage forms.

When coating solid dosage forms electrostatically with powder, the coating powder must be charged so that it can be transferred from the coating powder supply to the solid dosage form. This charging may be achieved by mixing the coating powder and shearing the coating powder sufficiently to impart an electric charge. The charging occurs to a large extent by triboelectric charging, for example by the contact between the coating powder and carrier particles mixed with the coating powder. If it is desired to apply powder to solid dosage forms at a reasonably high rate, as required for industrial production, this mixing process must be very efficient in order to supply sufficient quantities of charged coating powder.

It is an object of the invention to provide an improved method and apparatus for the application of powder material to solid dosage forms.

According to a first aspect of the invention, there is provided apparatus for electrostatically charging powder material and supplying it to an applicator for electrostatically applying the powder material to solid dosage forms, the apparatus comprising:

a mixer for mixing a sump of the powder material to electrostatically charge the powder material, the mixer comprising two substantially parallel elongate mixing shafts having oppositely angled mixing paddles thereon and being arranged to rotate in opposite directions; and a feeder for removing the electrostatically charged powder material from the sump and supplying it to the applicator.

The solid dosage forms may be oral dosage forms, for example, pharmaceutical tablets.

The use of two elongate mixing shafts promotes fast charging of the powder material by a shearing action. One or both of the mixing shafts may include slots for increasing the rate of charging of the powder material.

In an embodiment of the invention, the feeder comprises a rotatable paddle wheel. The paddle wheel may be magnetic.

The apparatus may further comprise a replenisher for replenishing the powder material in the sump. Preferably, the replenisher is connected to a sensor for monitoring the amount of powder material in the sump.

Advantageously, the mixer further comprises a third elongate mixing shaft substantially parallel to the first and second elongate mixing shafts, the third mixing shaft being positioned between the first and second mixing shafts, having mixing paddles thereon and being arranged to rotate in either direction, the paddles on the three mixing shafts being arranged to mesh as the mixing shafts rotate.

The use of three elongate mixing shafts promotes even faster charging of the powder material by a shearing action.

One or all of the mixing shafts may include slots for increasing the rate of charging of the powder material. The slots create more shearing sites for the powder material which increases the rate of electrostatic charging.

In an embodiment of the invention, the apparatus further comprises a sump of powder material. Preferably, the sump of powder material further comprises a magnetized carrier material mixed with the powder material. This is particularly useful where a magnetic feeder and/or applicator are used.

According to the first aspect of the invention, there is also provided a method for electrostatically charging powder material and supplying it to an applicator for electrostatically applying the powder material to solid dosage forms, the method comprising the steps of:

mixing a sump of the powder material to electrostatically charge the powder material, the step of mixing comprising rotating two substantially parallel elongate mixing shafts in opposite directions, the mixing shafts having oppositely angled mixing paddles;

removing the electrostatically charged powder from the sump; and supplying the electrostatically charged powder material to the applicator.

One or both of the mixing shafts may include slots for increasing the rate of charging of the powder material.

Preferably, the step of removing the electrostatically charged powder from the sump comprises rotating a paddle wheel, the paddle wheel removing powder material from the sump. The paddle wheel may be magnetic.

Preferably, the method further comprises the step of monitoring the amount of powder material in the sump.

Preferably, the method further comprises the step of replenishing the powder material in the sump.

In an advantageous embodiment of the invention, the step of mixing comprises rotating three substantially parallel elongate mixers, the third mixing shaft being positioned between the first and second mixing shafts and having mixing paddles thereon, the paddles on the three mixing shafts meshing as the mixing shafts rotate.

One or all of the mixing shafts may include slots for increasing the rate of charging of the powder material.

According to the first aspect of the invention, there is also provided apparatus for electrostatically charging powder material, the apparatus comprising a mixer for mixing a sump of the powder material to electrostatically charge the powder material, the mixer comprising three substantially parallel elongate mixing shafts, the first mixing shaft and the second mixing shaft having oppositely angled mixing paddles thereon and being arranged to rotate in opposite directions, the third mixing shaft being positioned between the first and second mixing shafts, having mixing paddles thereon and being arranged to rotate in either direction, the paddles on the three mixing shafts being arranged to mesh as the mixing shafts rotate.

According to the first aspect of the invention, there is also provided a method for electrostatically charging powder material, the method comprising mixing a sump of the powder material to electrostatically charge the powder material, the mixing comprising rotating three substantially parallel elongate mixing shafts, the first mixing shaft and the second mixing shaft having oppositely angled mixing paddles, the third mixing shaft being positioned between the first and second mixing shafts and having mixing paddles thereon, the paddles on the three mixing shafts meshing as the mixing shafts rotate.

According to a second aspect of the invention, there is provided an applicator for electrostatically applying powder material to solid dosage forms, the applicator comprising:

a sleeve for receiving a mixture of electrostatically charged powder material combined with a magnetized carrier material from a sump, the sleeve being arranged to have a rotating magnetic field applied thereto for rotating the mixture around the sleeve and the sleeve being arranged to have an electric potential applied thereto to drive the electrostatically charged powder material onto solid dosage forms passing alongside the sleeve.

The solid dosage forms may be oral dosage forms, for example, pharmaceutical tablets.

In an embodiment of the invention, the applicator comprises at least one magnet inside the sleeve for applying the rotating magnetic field to the sleeve. In one embodiment, the applicator comprises a plurality of magnets positioned in a cylinder inside the sleeve, the cylinder being arranged to rotate. Preferably, the cylinder is eccentrically mounted within the sleeve, so that the magnetic field provided by the magnets is higher in one portion of the sleeve than in another portion of the sleeve.

In an embodiment of the invention, the applicator comprises a second sleeve for receiving a mixture of electrostatically charged powder material combined with a magnetized carrier material from the sump, the second sleeve being arranged to have a rotating magnetic field applied thereto for rotating the mixture around the second sleeve and the second sleeve being arranged to have an electric potential applied thereto to drive the electrostatically charged powder material onto the solid dosage forms passing alongside the second sleeve.

In an embodiment of the invention, the applicator comprises at least one magnet inside the second sleeve for applying the rotating magnetic field to the sleeve. In one embodiment, the applicator comprises a plurality of magnets positioned in a cylinder inside the second sleeve, the cylinder being arranged to rotate. Preferably, the cylinder is eccentrically mounted within the second sleeve, so that the magnetic field provided by the magnets is higher in one portion of the second sleeve than in another portion of the second sleeve.

The first sleeve and the second sleeve are preferably arranged to have oppositely rotating magnetic fields applied thereto.

Providing two sleeves instead of one enables the rate at which substrates can be coated with powder to be increased. Further, rotating the magnetic fields of the sleeves in opposite directions tends to improve the uniformity of the coating.

It is advantageous if the applicator further comprises a blade alongside the sleeve or sleeves for controlling the height of the mixture on the sleeve or sleeves. The amount of powder material applied to the solid dosage forms can thereby be controlled. This is particularly advantageous if the distance between the applicator and solid dosage forms to which coating powder is applied is very small.

Advantageously, the solid dosage forms may be earthed before passing them alongside the sleeve or sleeves.

In an embodiment of the invention, the sleeve or sleeves are substantially cylindrical. In an alternative embodiment of the invention, the sleeve or sleeves are substantially in the shape of a cylinder but having a flattened portion running substantially the length of the sleeve located on the sleeve where the solid dosage forms are arranged to pass alongside the sleeve or sleeves. The provision of a flattened portion of the sleeve where the solid dosage forms pass alongside the sleeve assists in providing an even coating of the solid dosage forms. In another form of the invention, the flat top described above is replaced with a top that slopes down towards the offload side of the sleeve. The provision of a sloping top tends to reduce the edge effect that can occur in applicators of the form described herein.

In an embodiment of the invention, the sleeve or sleeves include a magnetic shield arranged to provide a localised reduction in the magnetic field strength at the surface of the sleeve at an offload position of said sleeve. In this embodiment of the invention, the offload position, that is, the position at which the magnetised carrier leaves the sleeve, can be controlled by controlling the location and thickness of the shield. The shield is preferably a mu-metal shield.

The reduction of the magnetic field strength at the offload position of the surface of the sleeve results in a significant reduction in the build up of magnetised carrier particles on the sleeve.

Preferably, the sleeve or sleeves are made from stainless steel. In one form of the invention, the sleeve is formed of a plastic inner sleeve with a thin metal shell over the top.

According to the second aspect of the invention, there is also provided a method for electrostatically applying powder material to solid dosage forms, the method comprising the steps of:

receiving a mixture of electrostatically charged powder material combined with a magnetized carrier material, from a sump onto a sleeve;

rotating the mixture around the sleeve by applying a rotating magnetic field to the sleeve;

passing solid dosage forms alongside the sleeve;

applying an electric potential to the sleeve, thereby driving the electrostatically charged powder material onto the solid dosage forms.

Preferably, the method further comprises the steps of:

receiving a mixture of electrostatically charged powder material combined with a magnetized carrier material, from the sump onto a second sleeve;

rotating the mixture around the second sleeve by applying a rotating magnetic field to the sleeve;

passing the solid dosage forms alongside the second sleeve;

applying an electric potential to the sleeve, thereby driving the electrostatically charged powder material onto the solid dosage forms.

Preferably, the rotating magnetic field applied to the first sleeve rotates in the opposite direction to the rotating magnetic field applied to the second sleeve.

In an embodiment of the invention, the method further comprises the step of returning the magnetized carrier material to the sump.

Preferably, the method further comprises the step of controlling the height of the mixture on the sleeve or sleeves. The step of controlling the height of the mixture on the sleeve or sleeves may be achieved by a blade alongside the sleeve or sleeves.

Advantageously, the method further comprises the step of earthing the solid dosage forms before passing them alongside the sleeve or sleeves.

The rotating magnetic field may be applied to the sleeve or sleeves by at least one magnet inside the sleeve or sleeves.

In an embodiment of the invention, the sleeve or sleeves are substantially cylindrical. In an alternative embodiment of the invention, the sleeve or sleeves are substantially in the shape of a cylinder but having a flattened portion running substantially the length of the sleeve located on the sleeve where the solid dosage forms are arranged to pass alongside the sleeve or sleeves. In another form of the invention, the flat top described above is replaced with a top that slopes down towards the offload side of the sleeve.

In an embodiment of the invention, the sleeve or sleeves include a magnetic shield arranged to provide a localised reduction in the magnetic field strength at the surface of the sleeve at an offload position of said sleeve. In this embodiment of the invention, the offload position, that is, the position at which the magnetised carrier leaves the sleeve, can be controlled by controlling the location and thickness of the shield. The shield is preferably a mu-metal shield.

The sleeve or sleeves may be made from stainless steel. In an alternative form of the invention, the sleeve is formed of a plastic inner sleeve with a thin metal shell over the top.

According to the second aspect of the invention, there is also provided an applicator for electrostatically applying powder material to substrates, the applicator comprising two sleeves for receiving a mixture of electrostatically charged powder material combined with a magnetic carrier material from one sump, the sleeves being arranged to have electric potentials applied thereto to drive the electrostatically charged powder material onto substrates passing alongside the sleeves, the sleeves being arranged to have rotating magnetic fields applied thereto for rotating the mixture around the sleeves, the magnetic fields applied to the two sleeves being arranged to rotate in opposite directions.

Providing two sleeves instead of one enables the rate at which substrates can be coated with powder to be increased. Further, rotating the magnetic fields of the sleeves in opposite directions tends to improve the uniformity of the coating.

According to the second aspect of the invention, there is also provided a method for electrostatically applying powder material to substrates, the method comprising the steps of:

receiving a mixture of electrostatically charged powder material combined with a magnetized carrier material, from one sump onto two sleeves;

rotating the mixture around the sleeves in opposite directions by applying a rotating magnetic field to each sleeve;

passing substrates alongside the sleeves;

applying an electric potential to each sleeve, thereby driving the electrostatically charged powder material onto the substrates.

According to the second aspect of the invention, there is also provided an applicator for electrostatically applying powder material to substrates, the applicator comprising:

a sleeve for receiving a mixture of electrostatically charged powder material combined with a magnetized carrier material from a sump, the sleeve being arranged to have a rotating magnetic field applied thereto for rotating the mixture around the sleeve, the sleeve being arranged to have an electric potential applied thereto to drive the electrostatically charged powder material onto substrates passing alongside the sleeve, and the sleeve being substantially in the shape of a cylinder but having a flattened portion running substantially the length of the sleeve located on the sleeve where the substrates are arranged to pass alongside the sleeve.

The provision of a flattened portion of the sleeve where the substrates pass alongside the sleeve assists in providing an even coating of the substrates.

According to the second aspect of the invention, there is also provided a method for electrostatically applying powder material to solid dosage forms, the method comprising the steps of:

receiving a mixture of electrostatically charged powder material combined with a magnetized carrier material, from a sump onto a sleeve, the sleeve being substantially in the shape of a cylinder but having a flattened portion running substantially the length of the sleeve;

rotating the mixture around the sleeve by applying a rotating magnetic field to the sleeve;

passing solid dosage forms alongside the flattened portion of the sleeve;

applying an electric potential to the sleeve, thereby driving the electrostatically charged powder material onto the solid dosage forms.

According to the second aspect of the invention, there is further provided an applicator for electrostatically applying powder material to substrates, the applicator comprising:

a sleeve for receiving a mixture of electrostatically charged powder material combined with a magnetized carrier material from a sump, the sleeve being arranged to have a rotating magnetic field applied thereto for rotating the mixture around the sleeve, the sleeve being arranged to have an electric potential applied thereto to drive the electrostatically charged powder material onto substrates passing alongside the sleeve, and the sleeve including a magnetic shield arranged to provide a localised reduction in the magnetic field strength at the surface of the sleeve at an offload position of said sleeve.

The reduction of the magnetic field strength at the offload position of the surface of the sleeve results in a significant reduction in the build up of magnetised carrier particles on the sleeve.

According to the second aspect of the invention, there is also provided a method for electrostatically applying powder material to solid dosage forms, the method comprising the steps of:

receiving a mixture of electrostatically charged powder material combined with a magnetized carrier material, from a sump onto a sleeve, the sleeve including a magnetic shield arranged to provide a localised reduction in the magnetic field strength at the surface of the sleeve at an offload position of said sleeve;

rotating the mixture around the sleeve by applying a rotating magnetic field to the sleeve;

passing solid dosage forms alongside the flattened portion of the sleeve;

applying an electric potential to the sleeve, thereby driving the electrostatically charged powder material onto the solid dosage forms.

According to a third aspect of the invention, there is provided apparatus for electrostatically applying powder material to solid dosage forms, the apparatus comprising apparatus as hereinbefore described according to the first aspect of the invention and an applicator as herein before described according to the second aspect of the invention.

According to the third aspect of the invention, there is also provided apparatus for electrostatically applying powder material to solid dosage forms, the apparatus comprising:

a mixer for mixing a sump of the powder material combined with a magnetized carrier material to electrostatically charge the powder material, the mixer comprising two substantially parallel elongate mixing shafts having oppositely angled mixing paddles thereon and being arranged to rotate in opposite directions:

a feeder for removing the mixture of electrostatically charged powder material and magnetized carrier material from the sump and supplying it to an applicator;

an applicator comprising a sleeve for receiving the mixture of electrostatically charged powder material and magnetized carrier material, the sleeve being arranged to have a rotating magnetic field applied thereto for rotating the mixture around the sleeve and the sleeve being arranged to have an electric potential applied thereto to drive the electrostatically charged powder material onto solid dosage forms passing alongside the sleeve.

The solid dosage forms may be oral dosage forms, for example, pharmaceutical tablets.

According to the third aspect of the invention, there is also provided a method for electrostatically applying powder material to solid dosage forms, the method comprising a method as hereinbefore described according to the first aspect of the invention and a method as hereinbefore described according to the second aspect of the invention.

According to the third aspect of the invention, there is also provided a method for electrostatically applying powder material to solid dosage forms, the apparatus comprising the steps of:

mixing a sump of the powder material combined with a magnetized carrier material to electrostatically charge the powder material, the step of mixing comprising rotating two substantially parallel elongate mixing shafts in opposite directions, the mixing shafts having oppositely angled mixing paddles;

removing the mixture of electrostatically charged powder material and magnetized carrier material from the sump; and supplying the mixture of electrostatically charged powder material and magnetized carrier material to a sleeve;

rotating the mixture around the sleeve by applying a rotating magnetic field to the sleeve;

passing solid dosage forms alongside the sleeve;

applying an electric potential to the sleeve, thereby driving the electrostatically charged powder material onto the solid dosage forms.

According to the third aspect of the invention, there is also provided apparatus for electrostatically applying powder material to substrates, the apparatus comprising:

a mixer for mixing a sump of the powder material combined with a magnetized carrier material to electrostatically charge the powder material, the mixer comprising three substantially parallel elongate mixing shafts, the first mixing shaft and the second mixing shaft having oppositely angled mixing paddles thereon and being arranged to rotate in opposite directions, the third mixing shaft being positioned between the first and second mixing shafts, having mixing paddles thereon and being arranged to rotate in either direction, the paddles on the three mixing shafts being arranged to mesh as the mixing shafts rotate;

a feeder for removing the mixture of electrostatically charged powder material and magnetized carrier material from the sump and supplying it to an applicator;

an applicator comprising a sleeve for receiving the mixture of electrostatically charged powder material and magnetized carrier material, the sleeve being arranged to have a rotating magnetic field applied thereto for rotating the mixture around the sleeve and the sleeve being arranged to have an electric potential applied thereto to drive the electrostatically charged powder material onto substrates passing alongside the sleeve.

According to the third aspect of the invention, there is also provided a method for electrostatically applying powder material to substrates, the method comprising the steps of:

mixing a sump of the powder material combined with a magnetized carrier material to electrostatically charge the powder material, the mixing comprising rotating three substantially parallel elongate mixing shafts, the first mixing shaft and the second mixing shaft having oppositely angled mixing paddles, the third mixing shaft being positioned between the first and second mixing shafts and having mixing paddles thereon, the paddles on the three mixing shafts meshing as the mixing shafts rotate;

removing the mixture of electrostatically charged powder material and magnetized carrier material from the sump;

supplying the mixture of electrostatically charged powder material and magnetized carrier material to a sleeve;

rotating the mixture around the sleeve by applying a rotating magnetic field to the sleeve;

passing substrates alongside the sleeve; and applying an electric potential to the sleeve, thereby driving the electrostatically charged powder material onto the substrates.

According to the third aspect of the invention, there is also provided apparatus for electrostatically applying powder material to substrates, the apparatus comprising:

a mixer for mixing a sump of the powder material combined with a magnetized carrier material to electrostatically charge the powder material, the mixer comprising two substantially parallel elongate mixing shafts having oppositely angled mixing paddles thereon and being arranged to rotate in opposite directions:

a feeder for removing the mixture of electrostatically charged powder material and magnetized carrier material from the sump and supplying it to an applicator;

an applicator comprising two sleeves for receiving a mixture of electrostatically charged powder material combined with a magnetic carrier material, the sleeves being arranged to have electric potentials applied thereto to drive the electrostatically charged powder material onto substrates passing alongside the sleeves, the sleeves being arranged to have rotating magnetic fields applied thereto for rotating the mixture around the sleeves, the magnetic fields applied to the two sleeves being arranged to rotate in opposite directions.

According to the third aspect of the invention, there is also provided a method for electrostatically applying powder material to substrates, the method comprising the steps of:

mixing a sump of the powder material combined with a magnetized carrier material to electrostatically charge the powder material, the step of mixing comprising rotating two substantially parallel elongate mixing shafts in opposite directions, the mixing shafts having oppositely angled mixing paddles;

removing the mixture of electrostatically charged powder material and magnetized carrier material from the sump;

supplying the mixture of electrostatically charged powder material and magnetized carrier material to two sleeves;

rotating the mixture around the sleeves in opposite directions by applying a rotating magnetic field to each sleeve;

passing substrates alongside the sleeves;

applying an electric potential to each sleeve, thereby driving the electrostatically charged powder material onto the substrates.

According to the third aspect of the invention, there is also provided apparatus for electrostatically applying powder material to substrates, the apparatus comprising:

a mixer for mixing a sump of the powder material combined with a magnetized carrier material to electrostatically charge the powder material, the mixer comprising three substantially parallel elongate mixing shafts, the first mixing shaft and the second mixing shaft having oppositely angled mixing paddles thereon and being arranged to rotate in opposite directions, the third mixing shaft being positioned between the first and second mixing shafts, having mixing paddles thereon and being arranged to rotate in either direction, the paddles on the three mixing shafts being arranged to mesh as the mixing shafts rotate; a feeder for removing the mixture of electrostatically charged powder material and magnetized carrier material from the sump and supplying it to an applicator;

an applicator comprising two sleeves for receiving a mixture of electrostatically charged powder material combined with a magnetic carrier material, the sleeves being arranged to have electric potentials applied thereto to drive the electrostatically charged powder material onto substrates passing alongside the sleeves, the sleeves being arranged to have rotating magnetic fields applied thereto for rotating the mixture around the sleeves, the magnetic fields applied to the two sleeves being arranged to rotate in opposite directions.

According to the third aspect of the invention, there is also provided a method for electrostatically applying powder material to substrates, the method comprising the steps of:

mixing a sump of the powder material combined with a magnetized carrier material to electrostatically charge the powder material, the mixing comprising rotating three substantially parallel elongate mixing shafts, the first mixing shaft and the second mixing shaft having oppositely angled mixing paddles, the third mixing shaft being positioned between the first and second mixing shafts and having mixing paddles thereon, the paddles on the three mixing shafts meshing as the mixing shafts rotate;

removing the mixture of electrostatically charged powder material and magnetized carrier material from the sump;

supplying the mixture of electrostatically charged powder material and magnetized carrier material to two sleeves;

rotating the mixture around the sleeves in opposite directions by applying a rotating magnetic field to each sleeve;

passing substrates alongside the sleeves;

applying an electric potential to each sleeve, thereby driving the electrostatically charged powder material onto the substrates.

According to the invention, there is also provided apparatus according to the third aspect of the invention further comprising a sump of powder material. Preferably, the apparatus is suitable for pharmaceutical applications and the powder material in the sump is pharmaceutically acceptable.

Preferably, the sump of powder material is contained in a replaceable cartridge. Preferably, the cartridge is replaceable by the user. Preferably, the cartridge is suitable for pharmaceutical applications.

According to the invention, there is also provided a sump of powder material for use with any aspect of the invention. Preferably, the powder material in the sump is pharmaceutically acceptable. According to the invention, there is also provided a cartridge comprising such a sump of powder material. Preferably, the cartridge is suitable for pharmaceutical applications.

The invention may also be applicable to the electrostatic application of powder material to other products, in particular medical products, for example stents, and the reader will understand that, where the term solid dosage form is used, the term stent may equally be used.

It should be understood that any features of the invention which are described with reference to one aspect of the invention may be equally applicable to another aspect of the invention.

Embodiments of the invention will now be described with reference to the accompanying schematic drawings of which:

Figure 1:
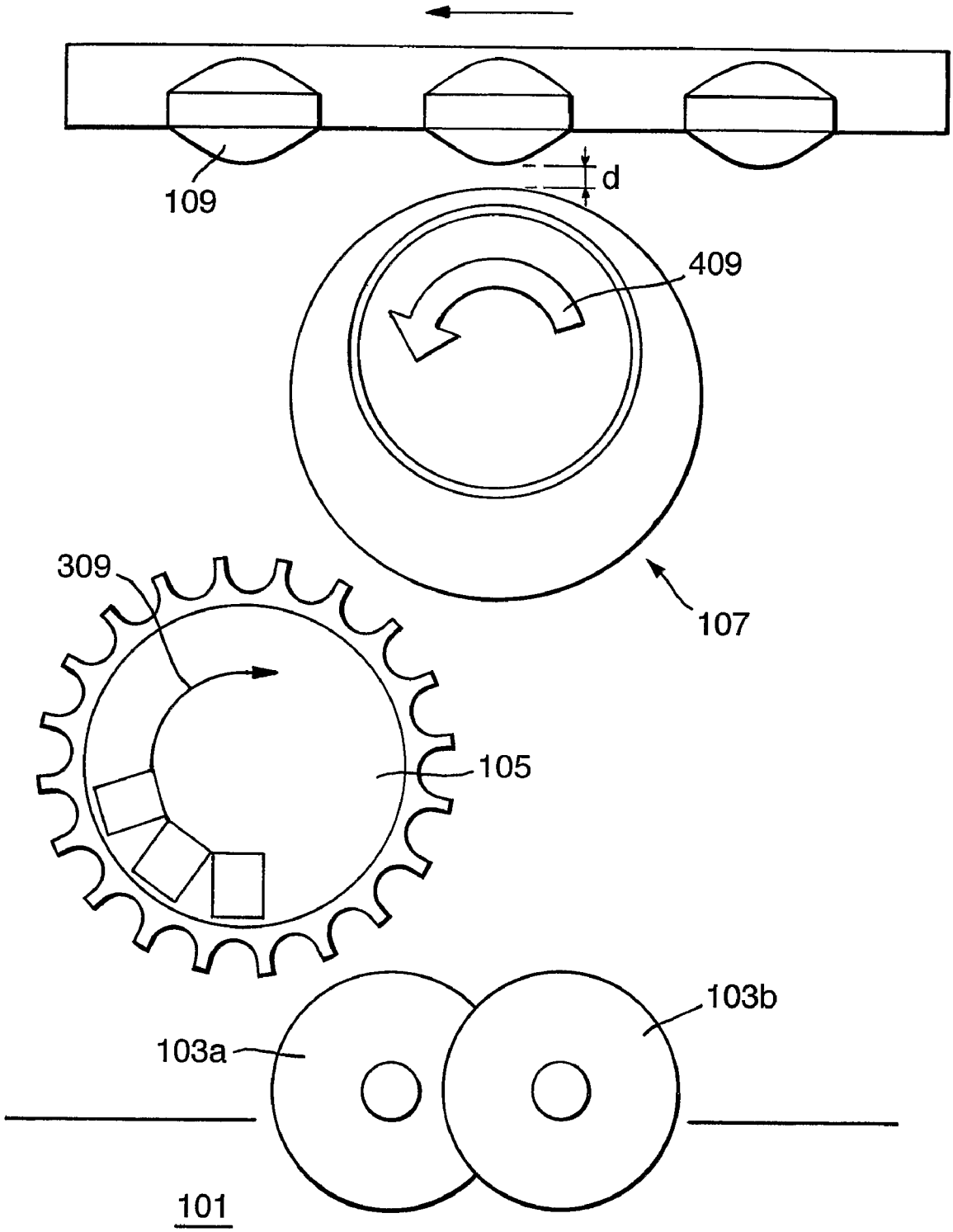
FIG. 1 is a schematic sectional view of a first embodiment of the invention.

FIG. 1 is a schematic sectional view of a first embodiment of the invention. A sump 101 of powder material mixed with a carrier is provided and is mixed by two shaft mixers 103*a* and 103*b* seen in cross section. The mixer arrangement is described in more detail with reference to FIG. 2. A bucket loader 105 rotates in the direction shown by the arrow 309, picking up the powder material and carrier from the sump 101 and transferring it to a sleeve/rotor arrangement shown generally at 107. The bucket loader 105 is described in more detail with reference to FIG. 3. The sleeve/rotor arrangement 107 transfers the powder material to solid dosage forms 109 passing over the sleeve/rotor arrangement at a controlled distance d. The sleeve/rotor arrangement 107 comprises an outer fixed sleeve and an inner rotor (which rotates in the direction shown by the arrow 409) and is described in more detail with reference to FIGS. 4 and 5.

As already mentioned, sump 101 comprises powder material mixed with a carrier. The powder material will be used for coating the solid dosage forms and is a toner-like material which is capable of being electrically charged. For pharmaceutical applications, the powder material must, of course, be pharmaceutically acceptable. The carrier is any suitable material capable of being magnetised. In this embodiment, the carrier is a quantity of permanently magnetised strontium ferrite beads. The powder material and carrier are mixed in a prescribed ratio which will be described in more detail below.

Figure 2:
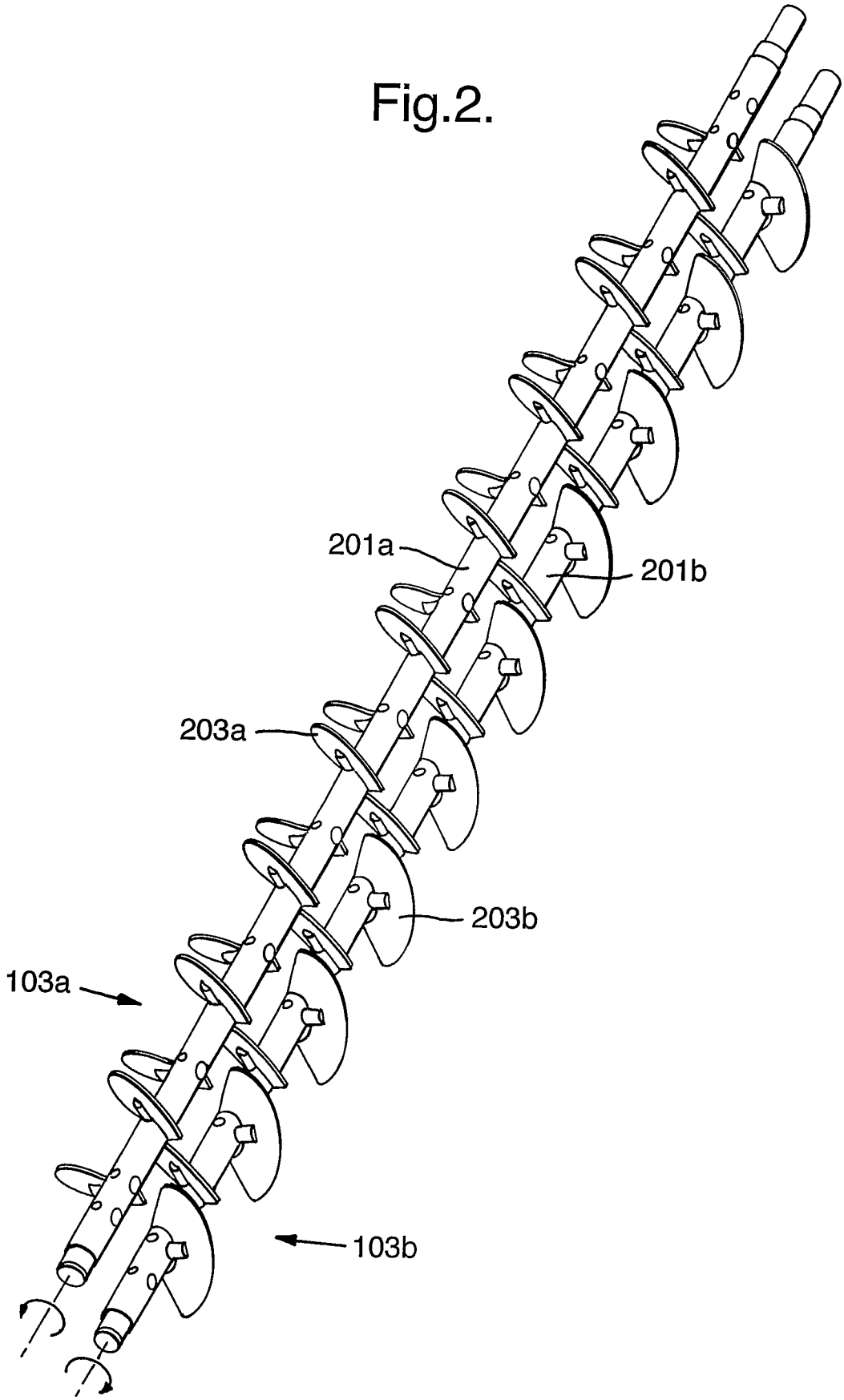
FIG. 2 is a perspective view of the paddle mixer arrangement of FIG. 1.

FIG. 2 is a perspective view of shaft mixers 103*a* and 103*b*, according to a first embodiment of the invention, which are provided in the sump 101 of powder material and carrier. In this embodiment, the sump itself is 'w' shaped with each mixer positioned in one side of the 'w'. Each mixer 103*a*, 103*b* comprises a shaft 201*a*, 201*b* with a number of crescent shaped paddles 203*a*, 203*b*. The paddles 203*a* on mixer 103*a* are angled in one axial direction and the paddles 203*b* on the other mixer 103*b* are angled in the opposite axial direction. Therefore, when mixer 103*a* rotates, it tends to drive the powder material and carrier to one end of the mixers and when mixer 103*b* rotates (in the opposite direction to mixer 103*a*), it tends to drive the powder material and carrier to the opposite end of the mixers. The shafts and paddles on the two mixers are positioned and phased relative to each other so that when rotated the paddles pass between each other. When the mixers are rotated simultaneously in opposite directions, each paddle on a shaft collects an amount of material and directs it towards the other shaft. The paddles are positioned such that this amount of material gets divided by a paddle on the opposite shaft, thereby creating a shearing action.

The active mixing and shearing system causes the powder material to electrically charge and attach to the carrier particles. The charging occurs to a large extent by triboelectric charging for example due to the frictional contact between the powder material and the carrier particles. The number of shearing sites (and hence the speed of charging) are increased by having a number of slots or holes in the paddles 203*a*, 203*b* (not shown), which results in greater agitation of the powder material/carrier blend. Of course, with slots or holes in the paddles, the amount of material which can be turned over by the paddles decreases. Thus this serves to decrease the amount of shearing whereas the holes themselves increase the amount of shearing. Thus, the optimum arrangement is one in which the overall shearing by these two routes is maximised.

It can be seen in FIG. 2 that the paddles 203*a* on shaft 201*a* are offset from paddles 203*b* on shaft 201*b* by 90°. This arrangement can cause some vibration and a more balanced arrangement (which is not illustrated) may be achieved by offsetting the paddles on the two shafts by 180° rather than 90°.

Figure 3:
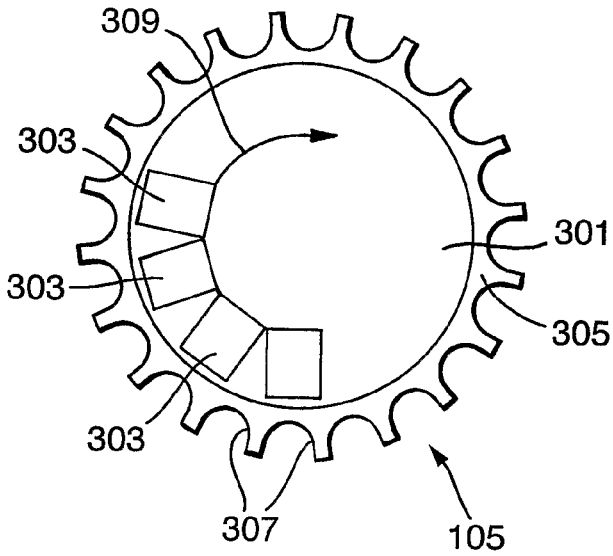
FIG. 3 is a sectional view of a bucket loader.

FIG. 3 shows bucket loader 105 in more detail. The bucket loader 105 comprises a non ferrous shaft 301 on which are mounted a series of magnets 303. In FIG. 3, four magnets 303 are shown positioned from 6 o'clock on the shaft round to 10 o'clock. However, the number of magnets may vary but the position of the magnets will remain substantially the same. Around the shaft is positioned an outer sleeve 305 having a number of buckets 307 machined onto its surface. The buckets 307 form curved slots along the length of the outer sleeve 305.

In use, the shaft 301 and magnets 303 remain stationary while the outer sleeve 305 rotates in the direction shown by the arrow 309. The bucket loader 105 is positioned above the mixer shafts so that the powder material and carrier are pulled up into the buckets 307 by the 6 o'clock magnet 303. (It will be remembered that the carrier is magnetised so is attracted by the magnets 303. The powder material is electrically charged due to the shearing provided by the mixers and is therefore attracted to the carrier as it moves up into the buckets.) As the outer sleeve 305 rotates, the powder material and carrier remain in the bucket by virtue of the magnets 303. There is sufficient magnetic strength to maintain material in the buckets until it reaches approximately 9 o'clock at which point the material remains in the bucket by virtue of gravity. As the bucket rotates further, the magnets on the rotor/sleeve arrangement attract the powder material and carrier onto the sleeve of the rotor/sleeve arrangement 107.

Of course, the bucket loader may be arranged to rotate in the opposite direction, in which case the magnets will instead be positioned from 6 o'clock round to 2 o'clock (in the anti-clockwise direction).

Figure 4:
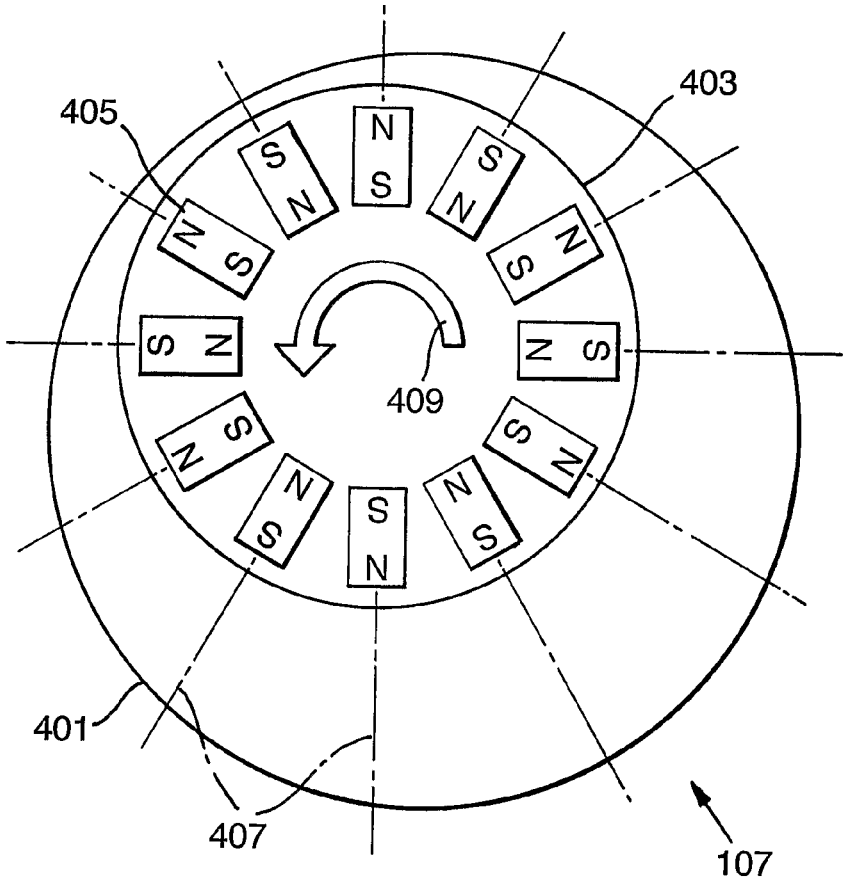
FIG. 4 is a sectional view of the sleeve/rotor arrangement.

FIG. 4 shows the construction of the sleeve/rotor arrangement 107 in more detail. As already mentioned, the sleeve/rotor arrangement 107 comprises an outer sleeve 401 and an inner rotor 403. The outer sleeve 401 is, in this embodiment, made from stainless steel. The magnets of the inner rotor 403 are, in this embodiment, sintered neodymium iron boron magnets. The rotor 403 is not mounted concentrically with the sleeve 401 but is mounted more closely to the top of the sleeve and more closely to the left hand side of the sleeve. The rotor comprises a number of magnets 405 positioned such that alternate magnets have opposite poles at the outside of the rotor. A small number of magnets are shown for clarity in FIG. 4 but it should be understood that, in reality, there will be many more magnets 405 on the rotor 403.

The effect of the magnetic fields is to create a series of opposite poles around the sleeve, shown schematically by dotted lines 407. The poles run in lines parallel to the axis of the sleeve. Because the rotor is not concentric with the sleeve, but is mounted more closely to the sleeve at the top and left, the magnetic field on the sleeve is stronger at the top of the sleeve than at the bottom of the sleeve and is stronger at the left hand side of the sleeve than at the right hand side of the sleeve.

In the arrangement of FIG. 4, the sleeve is stainless steel and usually needs to be at least 1 mm thick in order to retain its rigid structure. That thickness of metal can result in a large amount of heating due to Eddy currents resulting from the magnetic field (the Eddy current increasing with increasing metal thickness). In an alternative arrangement (not illustrated), the sleeve is, instead, formed from a plastic inner sleeve with a very thin metal shell over the top. The reduced metal thickness reduces the heating effect due to the magnetic field.

Figure 5:
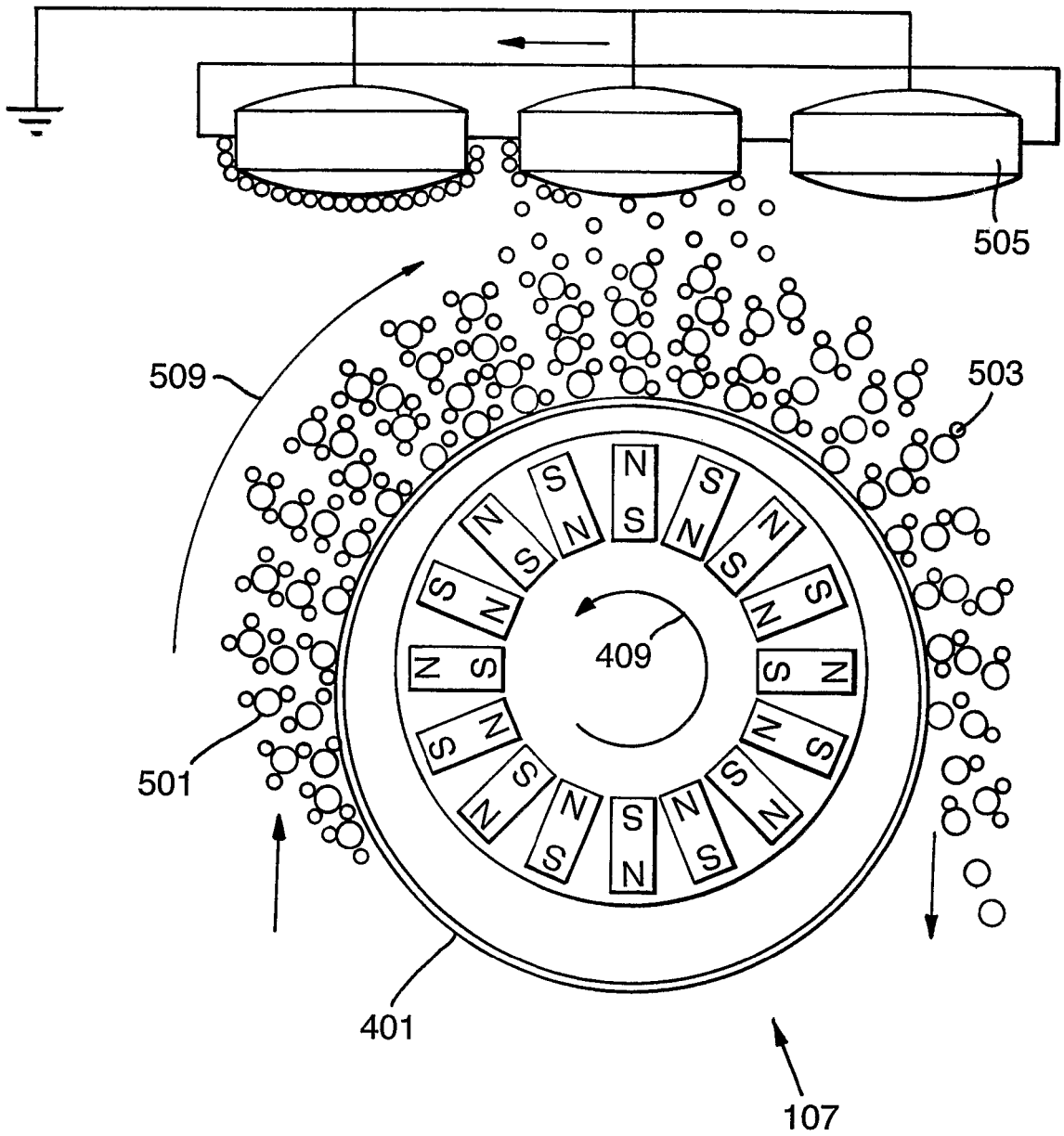
FIG. 5 is a schematic view of the sleeve/rotor arrangement showing coating of solid dosage forms.

FIG. 5 shows how the sleeve/rotor arrangement 107 is used to apply powder material to the solid dosage forms. The magnetised carrier 501 and the electrostatically charged powder material 503 are pulled onto the sleeve 401 from the bucket loader 105 by the magnets 405. The rotor 403 rotates in the anti-clockwise direction as shown by the arrow 409 so that the magnetic poles also rotate in the anti-clockwise direction. The carrier 501 and the electrostatically charged powder material 503 form chains running along the axial direction of the sleeve in line with poles and, as the rotor 403 rotates in the anti-clockwise direction, the chains progress around the sleeve 401 in the clockwise direction at a slower speed. The formation of material on the sleeve 401 is called the brush and, in FIG. 5, the brush rotates slowly around the sleeve 401 in the clockwise direction, as shown by the arrow 509.

Of course, the rotor may be arranged to rotate in the opposite direction i.e. clockwise, in which case the carrier and powder material will progress around the sleeve in the anti-clockwise direction.

A metering blade (not shown) forms a slot between the blade and the sleeve 401 so as to form the brush into a constant height. The speeds of the bucket loader 105 and the rotor 403 are chosen to supply an abundance of material to the sleeve/rotor arrangement so that, after the metering blade, the brush is of a controlled predetermined height.

A high voltage supply (not shown) is applied to the sleeve 401, the polarity chosen to create a potential difference that will drive the charged powder material particles towards any lower voltage parts. As the solid dosage forms 505 pass across the top of the sleeve 401, the solid dosage forms 505 are very close to the brush. The solid dosage forms 505 are arranged to be at, or close to, earth potential such that the electric potential on the sleeve is sufficient to drive the powder material 503 onto the exposed surfaces of the solid dosage forms 505. As the powder material deposits on the exposed surfaces of the solid dosage forms, a voltage builds up. This eventually balances the electric potential on the sleeve, so that no more powder material is driven onto the solid dosage forms. Thus, the electric potential applied to the sleeve can be used to control the amount of powder material deposited on the solid dosage forms. The distance d (see FIG. 1) can be used to control the electric field between the sleeve 401 and the solid dosage forms 505, and hence the rate of transfer of powder material onto the solid dosage forms.

The carrier material 501, however, remains magnetically attracted to the rotor magnets so remains on the sleeve. The carrier 501 continues to progress around the sleeve 401 in the clockwise direction, as shown by the arrow 509, as the rotor 403 rotates in the direction shown by the arrow 409 and eventually the carrier material 501 falls off the sleeve 401 and returns to the sump. The lower magnetic field at the offload portion of the sleeve (because of the eccentrically mounted rotor) facilitates this.

It will be appreciated that, because the powder material is being used up to coat the solid dosage forms whereas the carrier material is not being used up, if the sump were not monitored, the ratio of powder material to carrier would change. A concentration sensor is used for this purpose.

In this embodiment, the concentration sensor uses a ferrite core differential transformer to sense the permeability of the carrier/powder material mixture. In order for the concentration sensor to operate successfully, there must be a reasonable quantity of mixture in the sump so that there is sufficient mixture in front of the sensor to achieve a reasonable sensitivity. In practice, this may be a depth of about 5 mm of mixture. As the relative proportions of the carrier and the powder material change, the permeability of the mixture changes and the coupling between the transformer elements in the concentration sensor changes. A replenishment system, connected to the concentration sensor, adds new powder material to the sump so that the carrier to powder material ratio is maintained.

Figure 6:
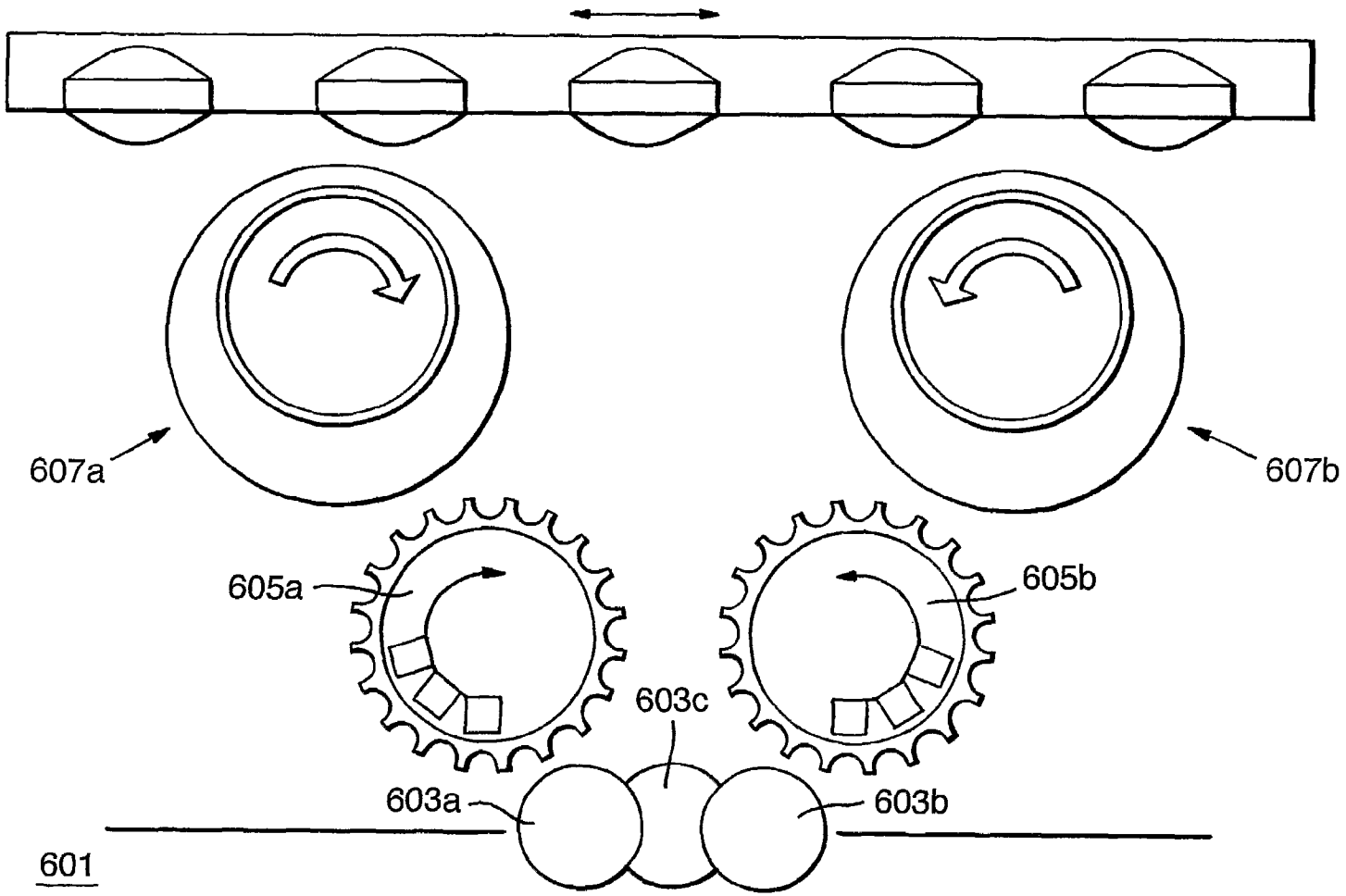
FIG. 6 is a schematic sectional view of a second embodiment of the invention.

FIG. 6 is a schematic sectional view of a second embodiment of the invention. A sump 601 of powder material mixed with a carrier is provided (just like in FIG. 1), but, in this embodiment, the sump is mixed by three shaft mixers 603*a*, 603*b*, 603*c* seen in cross section. The three mixer arrangement is described in more detail with reference to FIG. 7. Two counter rotating bucket loaders 605*a*, 605*b* pick up powder material and carrier from the sump 601 and transfer it to two sleeve/rotor arrangements 607*a*, 607*b*. The bucket loaders 605*a*, 605*b* are identical to bucket loader 105 described with reference to FIG. 3 so will not be described further. The sleeve/rotor arrangements 607*a*, 607*b* are identical to sleeve/rotor arrangement 107 described with reference to FIGS. 4 and 5 so will not be described further.

It should be noted that the bucket loaders 605*a* and 605*b* could rotate in the opposite directions to the directions shown in FIG. 6. Alternatively, or in addition, the sleeve/rotor arrangements 607*a*, 607*b* could rotate in the opposite directions to the directions shown in FIG. 6.

The advantages of the arrangement of FIG. 6 are numerous. Firstly, the three mixer arrangement provides more shearing sites and hence quicker charging of the powder material than the two mixer arrangement of FIG. 1. The three mixer arrangement provides further layout options for the two sleeve/rotor arrangement. Having more than one sleeve/rotor arrangement of course increases the time available for transferring the powder material onto the solid dosage forms. It is advantageous to draw powder material and carrier for both sleeve/rotor arrangements from one sump as this avoids inconsistency between sumps e.g. of powder material to carrier ratio. The three mixer arrangement facilitates this.

The two counter-rotating brushes also gives a more even coat on the tablet by minimising what is known as the "edge effect". The edge effect can be described as follows. As the carrier progresses around the sleeve, it eventually falls back into the sump. However, because of the magnets on the rotor there is a tendency for some carrier particles to remain on the sleeve even though the magnetic field strength at the bottom portion of the sleeve is lower. Thus, there can be a build up of carrier particles causing an "edge" of surplus carrier material which, as it extends around the sleeve, can inhibit the powder material from being driven onto the solid dosage forms. The two counter-rotating brushes in FIG. 6 minimise this because any edge effect in sleeve/rotor arrangement 607*a* is offset by the edge effect in sleeve/rotor arrangement 607*b*. If the edge effect still proves to be a problem even with the counter-rotating brush arrangement of FIG. 6, the speed of rotation of the two rotors can be adjusted to minimise the effect still further.

Figure 7:
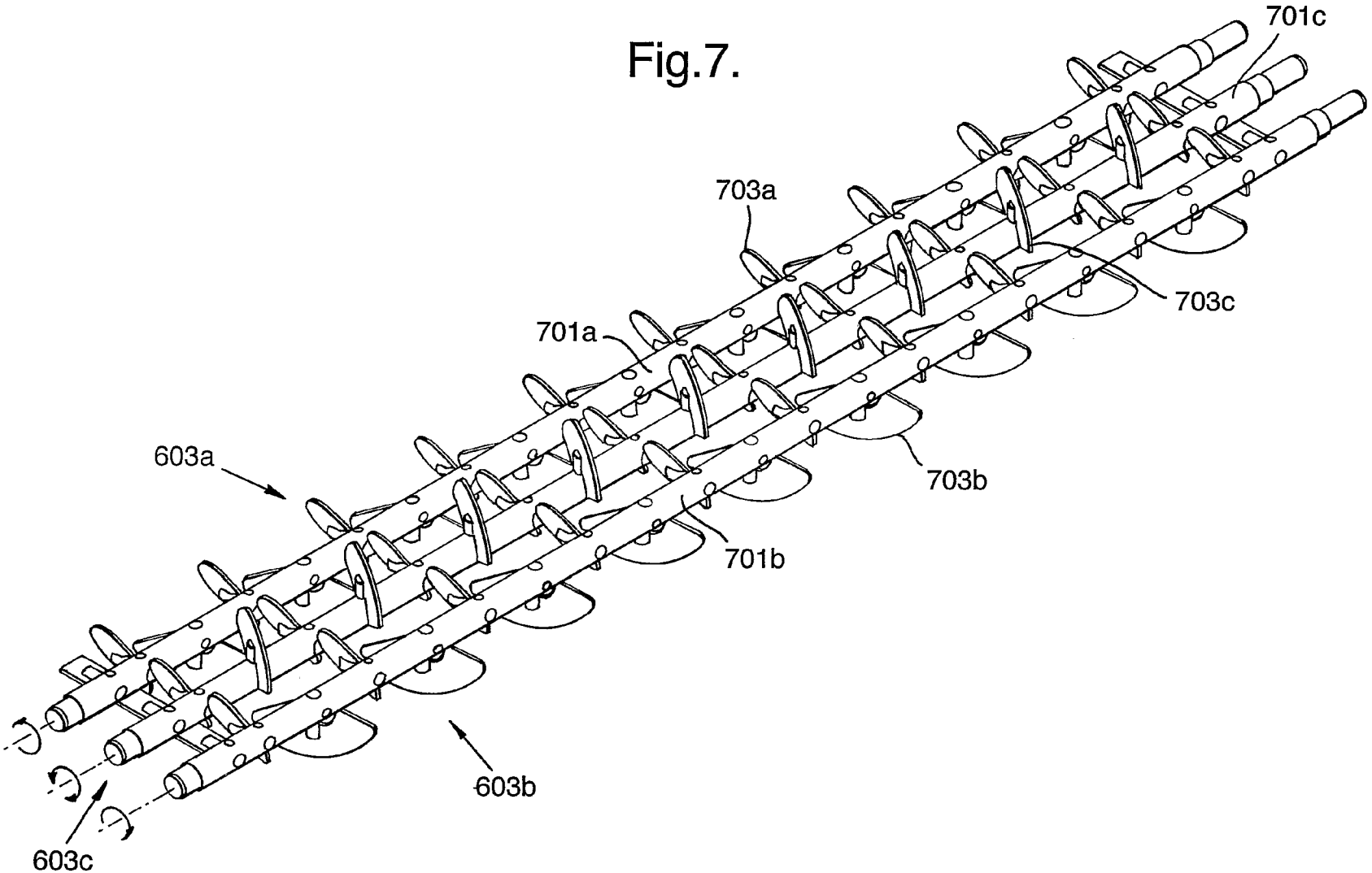
FIG. 7 is a perspective view of the paddle mixer arrangement of FIG. 6.

FIG. 7 is a perspective view of shaft mixers 603*a*, 603*b*, 603*c*, according to a second embodiment of the invention, which are provided in the sump 601 of powder material and carrier. In this embodiment sump 601 is 'triple-U' shaped, with each mixer positioned in one of the 'U's. Mixers 603*a*, 603*b* are similar to mixers 103*a*, 103*b* illustrated in FIG. 2. Each mixer 603*a*, 603*b* comprises a shaft 701*a*, 701*b* with a number of crescent shaped paddles 703*a*, 703*b*. The paddles 703*a* on mixer 603*a* are angled in one axial direction and the paddles 703*b* on the other mixer 603 are angled in the opposite axial direction. Thus, when mixer 603*a* rotates it tends to drive the powder material and carrier to one end of the mixers. When mixer 603*b* rotates (in the opposite direction to mixer 603*a*), it tends to drive the powder material and carrier to the opposite end of the mixers.

The third mixer 603*c* is positioned between mixers 603*a* and 603*b*. Mixer 603*c* comprises a shaft 701*c* with a number of crescent shaped paddles 703*c*. The paddles 703*c* on mixer 603*c* are not angled in either direction, but are perpendicular to the shaft 701*c* axis. Thus, when mixer 603*c* rotates it does not tend to drive the powder material and carrier to either end of the mixer, but simply mixes the powder material and carrier in situ. The mixer 603*c* can be arranged to rotate in either direction.

Just as with the two mixer arrangement of FIG. 2, the shafts and paddles on the three mixers are positioned and phased relative to each other so that when rotated the paddles pass between each other. As already mentioned, the three mixer arrangement increases the number of shearing sites and hence the speed of charging. As with the two mixer arrangement, the number of shearing sites may be further increased by having a number of slots or holes in the paddles 703*a*, 703*b*, 703*c*.

Figure 8:
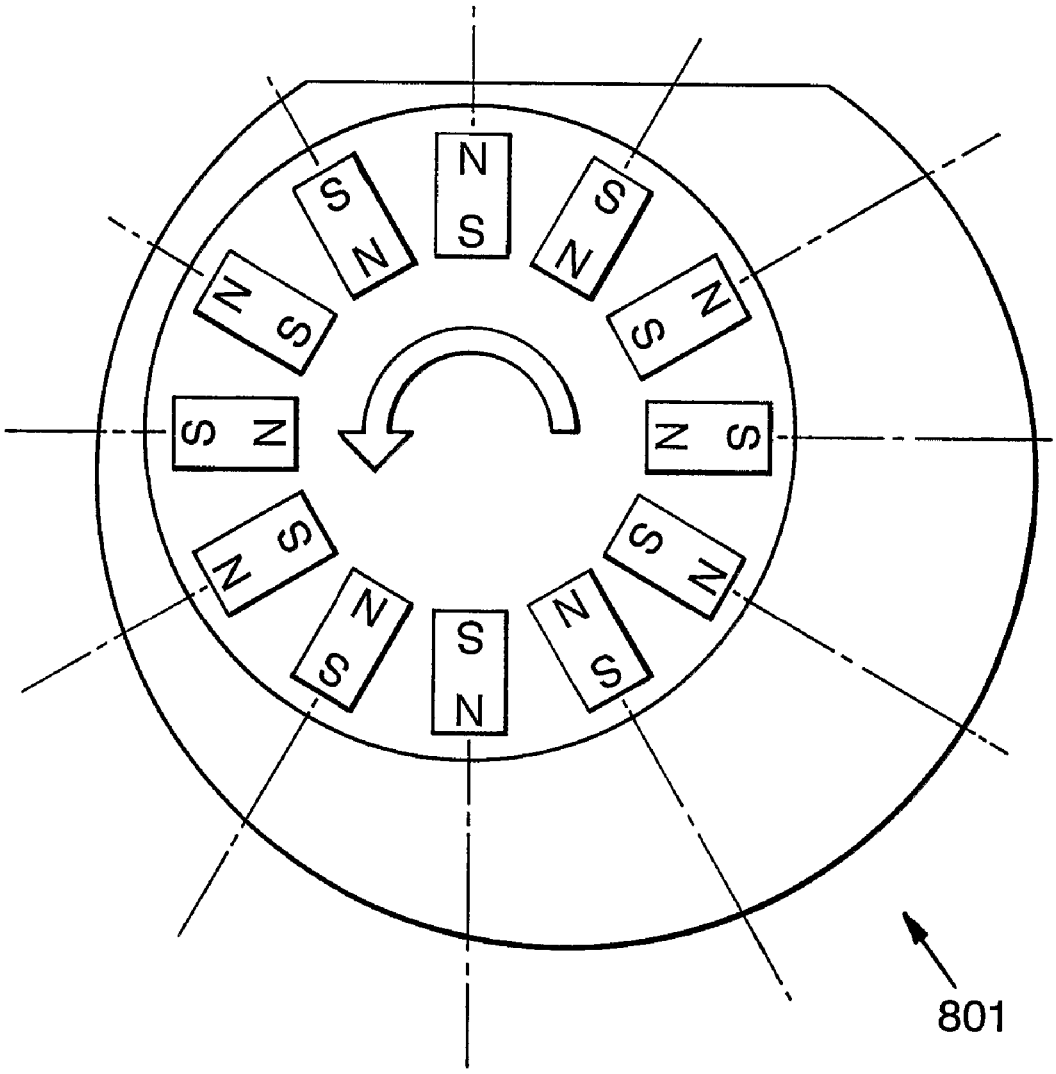
FIG. 8 is a schematic view of an alternative embodiment of the sleeve/rotor arrangement.

FIG. 8 shows an alternative form of sleeve/rotor arrangement 801 which could be used in the arrangement of FIG. 1 or FIG. 6. In this embodiment, the sleeve is not circular but, instead, has a flat top. This is advantageous because, in contrast to the circular sleeve arrangement, the distance between the solid dosage forms and the sleeve is constant for the duration of the flat sleeve top. This means that there is a constant electric field between the charged sleeve and the earthed solid dosage forms for the duration of the flat sleeve top. Thus, there is a longer period in which the powder material can be driven onto the dosage forms. A more consistent coating on the solid dosage forms may also be achieved because of the constant electric field.

A second alternative form of sleeve/rotor arrangement (not illustrated), may be used in the arrangement of FIG. 1 or FIG. 6. The edge effect described earlier means that there may be a build up of material at the offload side of the sleeve. Thus, even with the flat top arrangement of FIG. 8, the brush itself may not be entirely flat, which can be a problem if the brush needs to be very close to the solid dosage forms. In the alternative arrangement, the top is not flat but is, instead, sloping down towards the offload side of the sleeve in order to compensate for the material build up at that side. This arrangement can compensate (at least partially) for the edge effect and provide a flatter brush.

Figure 9:
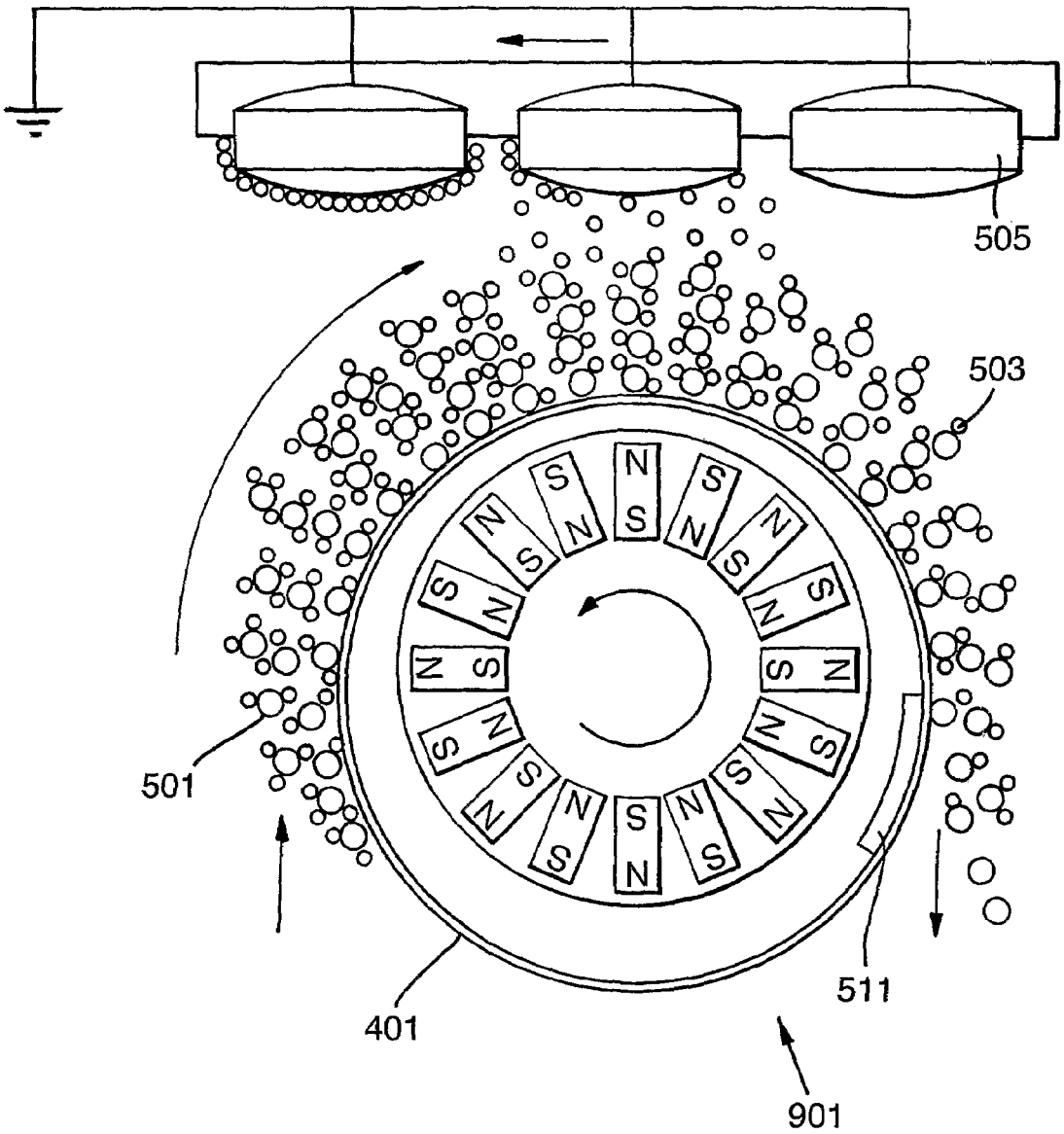
FIG. 9 is a schematic view of a further alternative embodiment of the sleeve/rotor arrangement.

FIG. 9 shows a further alternative form of sleeve/rotor arrangement 901 which could be used in the arrangement of FIG. 1 or FIG. 6. As described above, in the sleeve/rotor arrangement 107 described with reference to FIG. 5, as the magnetised carrier material 501 progresses around the sleeve, it eventually falls back into the sump, however, because of the magnets on the rotor there is a tendency for some carrier particles to remain on the sleeve even though the magnetic field strength at the bottom portion of the sleeve is lower. Thus, there can be a build up of carrier particles causing an "edge" of surplus carrier material which, as it extends around the sleeve, can inhibit the powder material from being driven onto the solid dosage forms.

As shown in FIG. 9, the sleeve/rotor arrangement 901 includes a mu-metal shield 511 located within the sleeve 401 at a desired offload position, i.e. the position at which it is desired that the carrier material 501 fall away from the arrangement 901 and return to the sump. Mu-metal is an alloy, typically comprising 77% nickel, 15% iron and small quantities of copper and molybdenum, that has a high magnetic permeability and can be used for screening magnetic fields. Accordingly, the mu-metal shield 511 causes a localised reduction in the magnetic field strength at the surface of the sleeve 401 at the offload position. Accordingly, any magnetised carrier that still remains on the sleeve at the offload position will tend to fall back into the sump as it reaches the offload position due to the significant reduction in the magnetic field strength at the offload position. In this way, the edge effect is significantly reduced when compared with the arrangement 107 described with reference to FIG. 5.

The offload position is dependent on the position and thickness of the mu-metal shield. Accordingly, the offload position can be controlled. This may be advantageous, for example, in order to return the magnetised carrier material 501 to the sump in the optimum position for combining with new material. By way of example, the offload position may be selected so as to maximise the time that the magnetised carrier material 501 is mixed with the material in the sump.

It should be noted that the mu-metal shield 501 can be located inside the sleeve 401 (as shown in FIG. 9) so that there are no carrier material contact issues associated with the shield 501.

The arrangement of FIG. 9 has a number of advantages over the arrangement of FIG. 5. The combination of the magnetised carrier 501 and electrostatically charged powder material 503 material on the sleeve 401 is freshly supplied from the mixer sump at all times. Accordingly, the material combination on the sleeve should correspond with the material combination in the sump, thereby leading to more consistent process conditions. The removal of the magnetised carrier 501 from the sleeve 401 is also beneficial at times when the sleeve is removed from the apparatus, for example for cleaning purposes.

Figure 10:
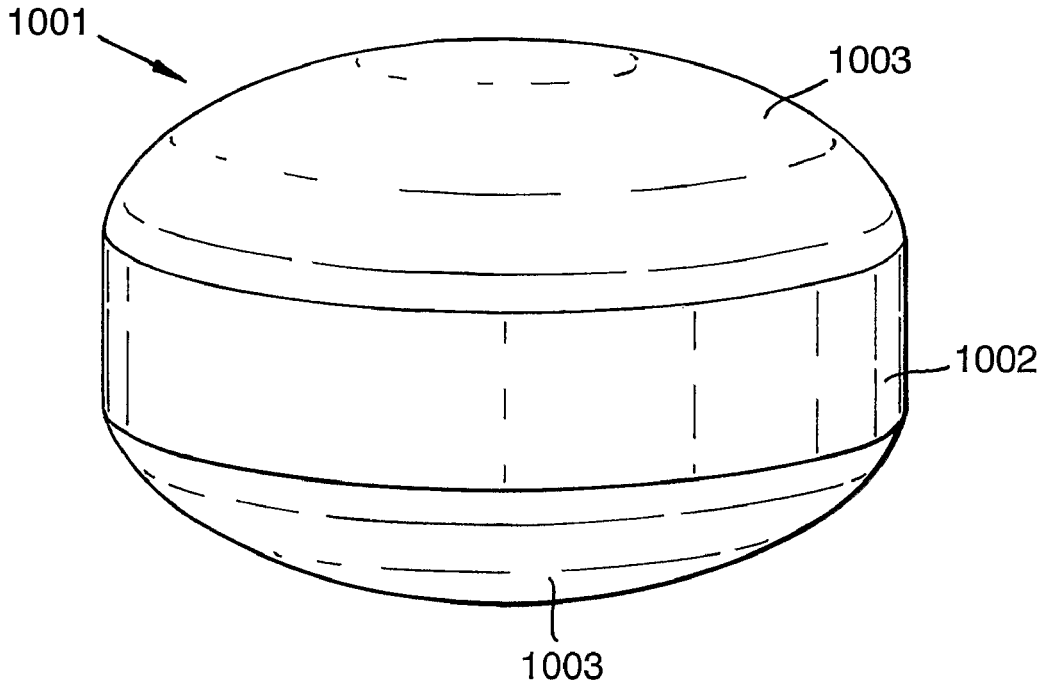
FIG. 10 is a perspective view of a solid dosage form suitable for use in any of the embodiments of the invention.

FIG. 10 is a perspective view of a solid dosage form 1001 that could be used in any of the embodiments of the present invention. In this example, the solid dosage form 1001 is a pharmaceutical tablet with a circumferential surface 1002 and two domed end surfaces 1003.

Figure 11:
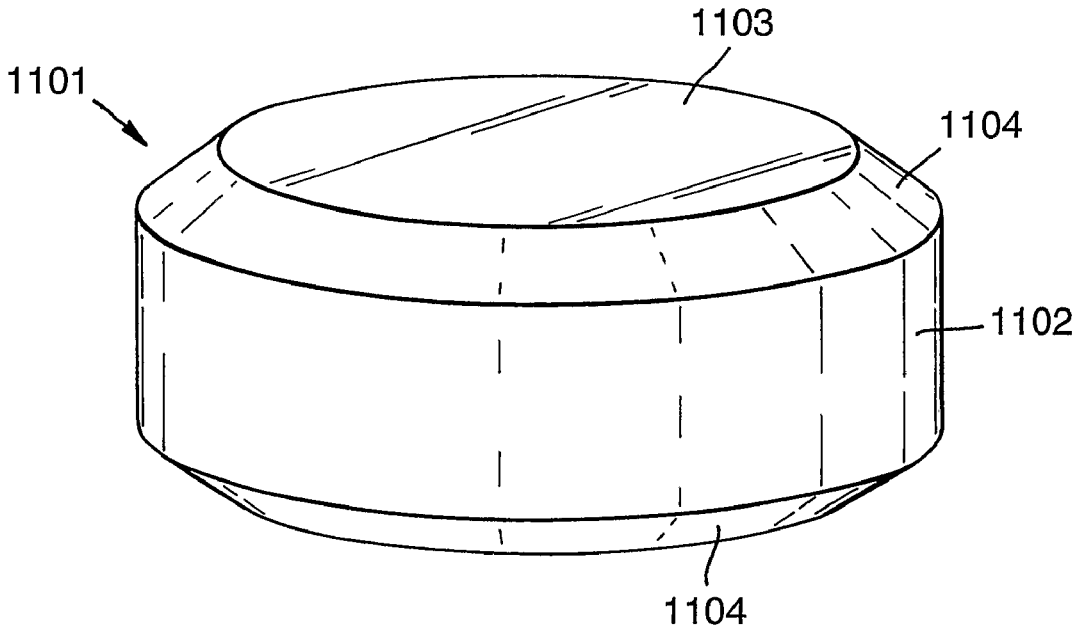
FIG. 11 is a perspective view of an alternative solid dosage form suitable for use in any of the embodiments of the invention.

FIG. 11 is a perspective view of a solid dosage form 1101 that could be used in any of the embodiments of the present invention. In this example, the solid dosage form 1101 is a pharmaceutical tablet with a circumference surface 1102 and two flat end surfaces 1103 (only one of the surfaces 1103 being visible in FIG. 11). A chamfered portion 1104 joins each of the flat end surfaces 1103 to the circumferential surface 1101.

Of course, the solid dosage forms described herein are just two of many possible solid dosage forms that could be used with the present invention. The solid dosage form could be any shape that is suitable for its particular application.

The invention claimed is:

1. Apparatus for electrostatically charging powder material and supplying it to an applicator for electrostatically applying the powder material to solid dosage forms, the apparatus comprising:

a mixer for mixing a sump of the powder material to electrostatically charge the powder material, the mixer comprising two substantially parallel elongate mixing shafts having oppositely angled mixing paddles thereon and being arranged to rotate in opposite directions; and a feeder for removing the electrostatically charged powder material from the sump and supplying it to the applicator.

2. Apparatus according to claim 1 wherein the feeder comprises a rotatable paddle wheel.

3. Apparatus according to claim 2 wherein the paddle wheel is magnetic.

4. Apparatus according to claim 1 further comprising a replenisher for replenishing the powder material in the sump.

5. Apparatus according to claim 4 wherein the replenisher is connected to a sensor for monitoring the amount of powder material in the sump.

6. Apparatus according to claim 1 wherein the mixer further comprises a third elongate mixing shaft substantially parallel to the first and second elongate mixing shafts, the third mixing shaft being positioned between the first and second mixing shafts, having mixing paddles thereon and being arranged to rotate in either direction, the paddles on the three mixing shafts being arranged to mesh as the mixing shafts rotate.

7. Apparatus according to claim 1 wherein at least one of the mixing shafts includes slots for increasing the rate of charging of the powder material.

8. Apparatus according to claim 1 further comprising a sump of powder material.

9. Apparatus according to claim 8 wherein the sump of powder material further comprises a magnetized carrier material mixed with the powder material.

10. Apparatus as claimed in claim 1, the apparatus further comprising an applicator for electrostatically applying powder material to solid dosage forms, the applicator comprising:

a sleeve for receiving a mixture of electrostatically charged powder material combined with a magnetized carrier material from a sump, the sleeve being arranged to have a rotating magnetic field applied thereto for rotating the mixture around the sleeve and the sleeve being arranged to have an electric potential applied thereto to drive the electrostatically charged powder material onto solid dosage forms passing alongside the sleeve.

11. Apparatus according to claim 10, wherein the applicator further comprises at least one magnet inside the sleeve for applying the rotating magnetic field to the sleeve.

12. Apparatus according to claim 10, wherein the applicator further comprises a second sleeve for receiving a mixture of electrostatically charged powder material combined with a magnetized carrier material from the sump, the second sleeve being arranged to have a rotating magnetic field applied thereto for rotating the mixture around the second sleeve and the second sleeve being arranged to have an electric potential applied thereto to drive the electrostatically charged powder material onto the solid dosage forms passing alongside the second sleeve.

13. Apparatus according to claim 12, wherein the applicator further comprises at least one magnet inside the second sleeve for applying the rotating magnetic field to the second sleeve.

14. Apparatus according to claim 12 wherein the first sleeve and the second sleeve are arranged to have oppositely rotating magnetic fields applied thereto.

15. Apparatus according to claim 10, wherein the applicator further comprises a blade alongside the sleeve or sleeves for controlling the height of the mixture on the sleeve or sleeves.

16. Apparatus according to claim 10, wherein the sleeve or sleeves are substantially cylindrical.

17. Apparatus according to claim 10, wherein the sleeve or sleeves are substantially in the shape of a cylinder but having a flattened portion running substantially the length of the sleeve located on the sleeve where the solid dosage forms are arranged to pass alongside the sleeve or sleeves.

18. Apparatus according to claim 10, wherein the sleeve or sleeves include a magnetic shield arranged to provide a localised reduction in the magnetic field strength at the surface of the sleeve at an offload position of said sleeve.

19. Apparatus according to claim 18, wherein said shield is a mu-metal shield.

20. Apparatus according to claim 10 wherein the sleeve or sleeves are made from stainless steel.

21. A method for electrostatically charging powder material and supplying it to an applicator for electrostatically applying the powder material to solid dosage forms, the method comprising the steps of:

mixing a sump of the powder material to electrostatically charge the powder material, the step of mixing comprising rotating two substantially parallel elongate mixing shafts in opposite directions, the mixing shafts having oppositely angled mixing paddles;

removing the electrostatically charged powder from the sump; and supplying the electrostatically charged powder material to the applicator.

22. A method according to claim 21 wherein the step of removing the electrostatically charged powder from the sump comprises rotating a paddle wheel, the paddle wheel removing powder material from the sump.

23. A method according to claim 22 wherein the paddle wheel is magnetic.

24. A method according to claim 21 further comprising the step of monitoring the amount of powder material in the sump.

25. A method according to claim 21 further comprising the step of replenishing the powder material in the sump.

26. A method according to claim 21 wherein the step of mixing comprises rotating three substantially parallel elongate mixers, the third mixing shaft being positioned between the first and second mixing shafts and having mixing paddles thereon, the paddles on the three mixing shafts meshing as the mixing shafts rotate.

27. A method according to claim 21 wherein at least one of the mixing shafts includes slots for increasing the rate of charging of the powder material.

28. A method as claimed in claim 21, further comprising the steps of:

receiving a mixture of electrostatically charged powder material combined with a magnetized carrier material, from a sump onto a sleeve of the applicator;

rotating the mixture around the sleeve by applying a rotating magnetic field to the sleeve;

passing solid dosage forms alongside the sleeve;

applying an electric potential to the sleeve, thereby driving the electrostatically charged powder material onto the solid dosage forms.

29. A method according to claim 28 further comprising the steps of:

receiving a mixture of electrostatically charged powder material combined with a magnetized carrier material, from the sump onto a second sleeve of the applicator;

rotating the mixture around the second sleeve by applying a rotating magnetic field to the sleeve;

passing the solid dosage forms alongside the second sleeve;

applying an electric potential to the sleeve, thereby driving the electrostatically charged powder material onto the solid dosage forms.

30. A method according to claim 29 wherein the rotating magnetic field applied to the first sleeve rotates in the opposite direction to the rotating magnetic field applied to the second sleeve.

31. A method according to claim 28 further comprising the step of returning the magnetized carrier material to the sump.

32. A method according to claim 28 further comprising the step of controlling the height of the mixture on the sleeve or sleeves.

33. A method according to claim 32 wherein the step of controlling the height of the mixture on the sleeve or sleeves is achieved by a blade alongside the sleeve or sleeves.

34. A method according to claim 28 further comprising the step of earthing the solid dosage forms before passing them alongside the sleeve or sleeves.

35. A method according to claim 28 wherein the rotating magnetic field is applied to the sleeve or sleeves by at least one magnet inside the sleeve or sleeves.

36. A method according to claim 28 wherein the sleeve or sleeves are substantially cylindrical.

37. A method according to claim 28 wherein the sleeve or sleeves are substantially in the shape of a cylinder but having a flattened portion running substantially the length of the sleeve located on the sleeve where the solid dosage forms are arranged to pass alongside the sleeve or sleeves.

38. A method according to claim 28 wherein the sleeve or sleeves include a magnetic shield arranged to provide a localised reduction in the magnetic field strength at the surface of the sleeve at an offload position of said sleeve.

39. A method according to claim 38, wherein said shield is a mu-metal shield.

40. A method according to claim 28 wherein the sleeve or sleeves are made from stainless steel.

41. Apparatus for electrostatically charging powder material, the apparatus comprising a mixer for mixing a sump of the powder material to electrostatically charge the powder material, the mixer comprising three substantially parallel elongate mixing shafts, the first mixing shaft and the second mixing shaft having oppositely angled mixing paddles thereon and being arranged to rotate in opposite directions, the third mixing shaft being positioned between the first and second mixing shafts, having mixing paddles thereon and being arranged to rotate in either direction, the paddles on the three mixing shafts being arranged to mesh as the mixing shafts rotate.

42. A method for electrostatically charging powder material, the method comprising mixing a sump of the powder material to electrostatically charge the powder material, the mixing comprising rotating three substantially parallel elongate mixing shafts, the first mixing shaft and the second mixing shaft having oppositely angled mixing paddles, the third mixing shaft being positioned between the first and second mixing shafts and having mixing paddles thereon, the paddles on the three mixing shafts meshing as the mixing shafts rotate.

43. Apparatus for electrostatically applying powder material to solid dosage forms, the apparatus comprising:

a mixer for mixing a sump of the powder material combined with a magnetized carrier material to electrostatically charge the powder material, the mixer comprising two substantially parallel elongate mixing shafts having oppositely angled mixing paddles thereon and being arranged to rotate in opposite directions:

a feeder for removing the mixture of electrostatically charged powder material and magnetized carrier material from the sump and supplying it to an applicator;

an applicator comprising a sleeve for receiving the mixture of electrostatically charged powder material and magnetized carrier material, the sleeve being arranged to have a rotating magnetic field applied thereto for rotating the mixture around the sleeve and the sleeve being arranged to have an electric potential applied thereto to drive the electrostatically charged powder material onto solid dosage forms passing alongside the sleeve.

44. A method for electrostatically applying powder material to solid dosage forms, the apparatus comprising the steps of:

mixing a sump of the powder material combined with a magnetized carrier material to electrostatically charge the powder material, the step of mixing comprising rotating two substantially parallel elongate mixing shafts in opposite directions, the mixing shafts having oppositely angled mixing paddles;

removing the mixture of electrostatically charged powder material and magnetized carrier material from the sump;

supplying the mixture of electrostatically charged powder material and magnetized carrier material to a sleeve;

rotating the mixture around the sleeve by applying a rotating magnetic field to the sleeve;

passing solid dosage forms alongside the sleeve; and applying an electric potential to the sleeve, thereby driving the electrostatically charged powder material onto the solid dosage forms.

45. Apparatus for electrostatically applying powder material to substrates, the apparatus comprising:

a mixer for mixing a sump of the powder material combined with a magnetized carrier material to electrostatically charge the powder material, the mixer comprising three substantially parallel elongate mixing shafts, the first mixing shaft and the second mixing shaft having oppositely angled mixing paddles thereon and being arranged to rotate in opposite directions, the third mixing shaft being positioned between the first and second mixing shafts, having mixing paddles thereon and being arranged to rotate in either direction, the paddles on the three mixing shafts being arranged to mesh as the mixing shafts rotate;

a feeder for removing the mixture of electrostatically charged powder material and magnetized carrier material from the sump and supplying it to an applicator;

an applicator comprising a sleeve for receiving the mixture of electrostatically charged powder material and magnetized carrier material, the sleeve being arranged to have a rotating magnetic field applied thereto for rotating the mixture around the sleeve and the sleeve being arranged to have an electric potential applied thereto to drive the electrostatically charged powder material onto substrates passing alongside the sleeve.

46. A method for electrostatically applying powder material to substrates, the method comprising the steps of:

mixing a sump of the powder material combined with a magnetized carrier material to electrostatically charge the powder material, the mixing comprising rotating three substantially parallel elongate mixing shafts, the first mixing shaft and the second mixing shaft having oppositely angled mixing paddles, the third mixing shaft being positioned between the first and second mixing shafts and having mixing paddles thereon, the paddles on the three mixing shafts meshing as the mixing shafts rotate;

removing the mixture of electrostatically charged powder material and magnetized carrier material from the sump;

supplying the mixture of electrostatically charged powder material and magnetized carrier material to a sleeve;

rotating the mixture around the sleeve by applying a rotating magnetic field to the sleeve;

passing substrates alongside the sleeve; and applying an electric potential to the sleeve, thereby driving the electrostatically charged powder material onto the substrates.

47. Apparatus for electrostatically applying powder material to substrates, the apparatus comprising:

a mixer for mixing a sump of the powder material combined with a magnetized carrier material to electrostatically charge the powder material, the mixer comprising two substantially parallel elongate mixing shafts having oppositely angled mixing paddles thereon and being arranged to rotate in opposite directions:

a feeder for removing the mixture of electrostatically charged powder material and magnetized carrier material from the sump and supplying it to an applicator;

an applicator comprising two sleeves for receiving a mixture of electrostatically charged powder material combined with a magnetic carrier material, the sleeves being arranged to have electric potentials applied thereto to drive the electrostatically charged powder material onto substrates passing alongside the sleeves, the sleeves being arranged to have rotating magnetic fields applied thereto for rotating the mixture around the sleeves, the magnetic fields applied to the two sleeves being arranged to rotate in opposite directions.

48. A method for electrostatically applying powder material to substrates, the method comprising the steps of:

mixing a sump of the powder material combined with a magnetized carrier material to electrostatically charge the powder material, the step of mixing comprising rotating two substantially parallel elongate mixing shafts in opposite directions, the mixing shafts having oppositely angled mixing paddles;

removing the mixture of electrostatically charged powder material and magnetized carrier material from the sump;

supplying the mixture of electrostatically charged powder material and magnetized carrier material to two sleeves;

rotating the mixture around the sleeves in opposite directions by applying a rotating magnetic field to each sleeve;

passing substrates alongside the sleeves;

applying an electric potential to each sleeve, thereby driving the electrostatically charged powder material onto the substrates.

49. Apparatus for electrostatically applying powder material to substrates, the apparatus comprising:

a mixer for mixing a sump of the powder material combined with a magnetized carrier material to electrostatically charge the powder material, the mixer comprising three substantially parallel elongate mixing shafts, the first mixing shaft and the second mixing shaft having oppositely angled mixing paddles thereon and being arranged to rotate in opposite directions, the third mixing shaft being positioned between the first and second mixing shafts, having mixing paddles thereon and being arranged to rotate in either direction, the paddles on the three mixing shafts being arranged to mesh as the mixing shafts rotate;

a feeder for removing the mixture of electrostatically charged powder material and magnetized carrier material from the sump and supplying it to an applicator;

an applicator comprising two sleeves for receiving a mixture of electrostatically charged powder material combined with a magnetic carrier material, the sleeves being arranged to have electric potentials applied thereto to drive the electrostatically charged powder material onto substrates passing alongside the sleeves, the sleeves being arranged to have rotating magnetic fields applied thereto for rotating the mixture around the sleeves, the magnetic fields applied to the two sleeves being arranged to rotate in opposite directions.

50. A method for electrostatically applying powder material to substrates, the method comprising the steps of:

mixing a sump of the powder material combined with a magnetized carrier material to electrostatically charge the powder material, the mixing comprising rotating three substantially parallel elongate mixing shafts, the first mixing shaft and the second mixing shaft having oppositely angled mixing paddles, the third mixing shaft being positioned between the first and second mixing shafts and having mixing paddles thereon, the paddles on the three mixing shafts meshing as the mixing shafts rotate;

removing the mixture of electrostatically charged powder material and magnetized carrier material from the sump;

supplying the mixture of electrostatically charged powder material and magnetized carrier material to two sleeves;

rotating the mixture around the sleeves in opposite directions by applying a rotating magnetic field to each sleeve;

passing substrates alongside the sleeves;

applying an electric potential to each sleeve, thereby driving the electrostatically charged powder material onto the substrates.

* * * * *